US007685855B2

(12) United States Patent
Suzuki et al.

(10) Patent No.: US 7,685,855 B2
(45) Date of Patent: Mar. 30, 2010

(54) VERTICALLY SHAKING WORKING DEVICE

(75) Inventors: Matsuo Suzuki, Kikugawa (JP); Shinichirou Azuma, Kikugawa (JP); Takayuki Sakai, Kikugawa (JP); Kiyomi Hagita, Kikugawa (JP); Atsurou Yamamoto, Kikugawa (JP)

(73) Assignee: Asahi Tec Corporation, Kikugawa (JP)

( * ) Notice: Subject to any disclaimer, the term of this patent is extended or adjusted under 35 U.S.C. 154(b) by 0 days.

(21) Appl. No.: 12/225,663

(22) PCT Filed: Mar. 30, 2007

(86) PCT No.: PCT/JP2007/057227

§ 371 (c)(1),
(2), (4) Date: Sep. 26, 2008

(87) PCT Pub. No.: WO2007/114377

PCT Pub. Date: Oct. 11, 2007

(65) Prior Publication Data

US 2009/0107197 A1 Apr. 30, 2009

(30) Foreign Application Priority Data

Mar. 30, 2006 (JP) ..... 2006-094335

(51) Int. Cl.
*C21D 7/06* (2006.01)
*B24B 31/10* (2006.01)

(52) U.S. Cl. ..... 72/53; 451/66; 451/106; 451/108; 451/163; 241/175; 164/132

(58) Field of Classification Search ..... 72/53; 451/39, 80, 82, 66, 106, 108, 163; 241/175, 241/179; 164/132
See application file for complete search history.

(56) References Cited

U.S. PATENT DOCUMENTS 3,433,421 A * 3/1969 Moore ..... 241/175
3,574,801 A 4/1971 Jauker (Continued)

FOREIGN PATENT DOCUMENTS

DE 41 30 531 A1 3/1992

(Continued)

OTHER PUBLICATIONS

International Search Report mailed May 15, 2007, issued on PCT/JP2007/057227.

(Continued)

*Primary Examiner*—David B Jones
(74) *Attorney, Agent, or Firm*—Edwards Angell Palmer & Dodge LLP

(57) ABSTRACT

A vertically oscillating working device 2 has a body to be oscillated 23 having an inner space that is formed by a cover member 21 and a vehicle wheel 22, which is a body to be worked, and receives working materials 25 in it and also has oscillating means for vertically oscillating the body to be oscillated 23. The working materials 25 are allowed to collide with the vehicle wheel 22 by the oscillation, and thereby the vehicle wheel 22 is worked. With the working device 2, a casting can be oscillated together with hardening materials, and excellent mechanical properties can be uniformly added to a predetermined portion of the casting by the oscillation without changing the position of the casting.

5 Claims, 3 Drawing Sheets

U.S. PATENT DOCUMENTS

| | | | | |
|---|---|---|---|---|
| 3,650,482 | A * | 3/1972 | Andrews | 241/153 |
| 5,364,672 | A | 11/1994 | Schultze-Kraft | |
| 5,460,219 | A * | 10/1995 | Massin et al. | 164/132 |
| 5,702,060 | A * | 12/1997 | Matteazzi et al. | 241/175 |
| 5,879,601 | A | 3/1999 | Baker | |
| 6,350,501 | B1 | 2/2002 | Guariento | |
| 6,770,328 | B1 | 8/2004 | Whalley | |
| 7,458,881 | B2 * | 12/2008 | Kawashima et al. | 72/53 |
| 2004/0000384 | A1 | 1/2004 | Kawashima et al. | |
| 2004/0050457 | A1 | 3/2004 | Kawashima et al. | |
| 2006/0160472 | A1 | 7/2006 | Kawashima et al. | |

FOREIGN PATENT DOCUMENTS

| | | | |
|---|---|---|---|
| DE | 44 18 535 | A1 | 2/1995 |
| DE | 197 55 626 | A1 | 6/1999 |
| EP | 0 524 578 | A1 | 1/1993 |
| EP | 1 264 638 | A | 12/2002 |
| GB | 975 756 | A | 11/1964 |
| JP | 61-009961 | | 1/1986 |
| JP | 04-289069 | | 10/1992 |
| JP | 08-11366 | | 3/1993 |
| JP | 07-308751 | | 11/1995 |
| JP | 10-286665 | | 10/1998 |
| JP | 2002-327403 | A | 11/2002 |
| JP | 2004-174604 | | 6/2004 |
| JP | 2004-322112 | | 11/2004 |
| WO | WO-2004/003394 | | 1/2004 |
| WO | WO 2005/121041 | A1 | 12/2005 |

OTHER PUBLICATIONS

PCT Search Report dated Sep. 17, 2007.

* cited by examiner

VERTICALLY SHAKING WORKING DEVICE

TECHNICAL FIELD

The present invention relates to a vertically oscillating working device which works a body to be worked by oscillating the body to be worked together with working materials in upward and downward directions (vertical direction) to collide the working materials with the surface of the body to be worked.

BACKGROUND ART

Shot peening treatment has been known as a means for improving mechanical properties of a casting (see, for example, Patent Document 1). The shot peening treatment is a cold working carried out as a post-step for a casting, and is a technology according to which the surface layer of a casting is subjected to plastic deformation by projecting fine particles at a high speed to generate residual compressive stress, whereby mechanical strength of the casting can be improved.

However, since this shot peening treatment can treat only the surface layer above the surface of a casting, it does not have the effect to remove internal defects which may be present above the surface of a casting, and has limit in improving mechanical properties of a casting and may rather induce deterioration in properties of the surface layer of a casting.

Therefore, the applicant has proposed a method for hardening of a casting as a new alternative means for the shot peening (see Patent Document 2). This is a means to form a dense layer at the surface side of the casting thicker than the plastic deformation layer formed by shot peening, and according to the method for hardening of castings disclosed in Patent Document 2, desired mechanical properties can be imparted to a casting. This method for hardening of a casting is a means to form a dense layer by oscillating the castings together with a hardening material to collide the hardening material against the surface of a casting. Therefore, a oscillating device is necessary for performing this means.

The oscillating device is disclosed in Patent Document 2, and, besides, the applicant has made a new proposal in Patent Document 3. Moreover, as prior art documents relating to oscillating, there are known Patent Document 4 disclosing a barrel polishing technology proposed by the applicant, and Patent Document 5 and Patent Document 6 presenting a technology to remove core sand.

Patent Document 1: JP-B-8-11366

Patent Document 2: JP-A-2004-322112

Patent Document 3: JP-A-2004-174604

Patent Document 4: JP-A-4-289069

Patent Document 5: JP-A-10-286665

Patent Document 6: JP-A-61-9961

DISCLOSURE OF INVENTION

The oscillating device proposed in Patent Document 3 gives oscillation in horizontal direction, and if the method for hardening of a casting disclosed in Patent Document 2 is carried out using the oscillating device, the position at which the hardening materials collide with a casting is inevitably concentrated at the lower portion of a casting by gravity when the casting is oscillated together with the hardening materials. Therefore, in order to uniformly impart excellent mechanical properties to a casting, the oscillating must be repeatedly carried out with changing the position of placing the casting, which is troublesome and requires a long time causing difficulty in performing uniform treatment. Thus, these problems must be solved.

The present invention has been accomplished in view of the situations described above, and the object of the present invention is to provide a means according to which a casting can be oscillated together with hardening materials, and excellent mechanical properties can be uniformly imparted to a predetermined portion of the casting by the oscillation without changing the position of the casting. As a result of repeated studies, it has been found that the above object can be attained by the following means.

That is, the present invention provides a vertically oscillating working device which has a body to be oscillated comprising an inner space that is formed by a cover member and a body to be worked and receives working materials in it and a oscillating means for vertically oscillating the body to be oscillated, and which works the body to be worked by colliding the working materials with the body to be worked by the oscillating.

In the vertically oscillating working device of the present invention, it is preferred that the oscillating means has a oscillating mechanism having a prime mover, a revolving shaft connected to the prime mover, a crank provided at the revolving shaft, a oscillating plate connected with the crank through a connecting rod, two or more linear motion guides which are fitted to the oscillating plate and vertically reciprocate the oscillating plate, and the rotary motion given by the prime mover is converted to vertical motion by the crank fitted to the revolving shaft, and the oscillating plate connected with the crank reciprocates vertically along the linear motion guide, thereby to vertically oscillate the body to be oscillated fixed at the oscillating plate.

In the present specification, the term oscillation does not mean oscillating motion on a rotating orbit, but means reciprocating motion in nearly linear state (on a linear orbit) in upward and downward direction (vertical direction, gravity direction). The oscillating means a rapid periodic motion with a large oscillating amplitude (vibrational amplitude) and a small number of oscillating (number of vibration), although the invention is not limited by this definition. Since the oscillation is similar in meaning to vibration in concept, secondary vibrations which are not oscillating per se, but are generated from oscillating and are to be inhibited are called bad vibrations in the present specification.

Furthermore, in the present specification, to work a body to be worked means to cause change in a body to be worked by colliding a working material with a body to be worked, and change means change in properties, state, outer shape, etc. Moreover, in the present specification, a rotating shaft is connected with a prime mover means that a rotating shaft and a prime mover are connected to each other directly or through a given transmission member. The transmission member is, for example, belt, gear, or the like.

In the vertically oscillating working device of the present invention, a linear bearing, a ball spline bearing for infinite sliding, an oilless bearing or the like can be employed. The oscillating plate is preferably a flat plate, but is not limited in shape as far as the body to be oscillated can be fixed thereon, and in case the body to be oscillated has a special shape, it may be fixed through a fixing jig. The prime mover is preferably an electric motor, but is not limited to electric motor, and therefore, an internal combustion engine, or the like may be employed.

In the vertically oscillating working device of the present invention, it is preferred that another crank is further fitted to the revolving shaft, and a counter weight is fitted to the crank (the another crank).

In the vertically oscillating working device of the present invention, the two cranks are provided facing opposite at an angle of 180°. The counter weight fitted to one of the two cranks acts as a balancer. The oscillating plate is fitted to the two or more linear motion guides, but the number of the linear motion guides is not limited. Thus, for example, one oscillating plate may be fitted to four linear motion guides.

In the vertically oscillating working device of the present invention, when it has the above-mentioned oscillating mechanism, it is preferred to provide an air spring between the oscillating mechanism and the floor on which the oscillating mechanism is placed. In the case of the air spring being provided, it is preferred to provide a weight on both sides of the oscillating mechanism and just above the air spring.

In the vertically oscillating working device of the present invention, it is preferred that the working materials are steel balls having a diameter of 3-30 mm ϕ.

The vertically oscillating working device of the present invention can be suitably used when the body to be worked is a vehicle wheel.

In addition, as the body to be worked, mention may be made of, for example, vehicle ventilation parts including intake manifold, turbine housing, compressor cover, cylinder head, cylinder, and air duct, and various worked articles having fins, flashes, scales, etc.

The vertically oscillating working device of the present invention has a body to be oscillated having an inner space that is formed by a cover member and a body to be worked, and receives working materials in it, and a oscillating means for vertically oscillating the body to be oscillated, and the working materials are made to collide with the body to be worked by the vertical oscillating, and thereby the body to be worked is worked. Therefore, the method for hardening of a casting (Patent Document 2) can be performed, for example, by using a hardening material as the working materials, and using the casting (e.g., vehicle wheel) as the body to be worked.

Since the vertically oscillating working device of the present invention brings about oscillation in vertical direction, in the case of oscillating a casting together with hardening materials, the hardening materials uniformly collide with the casting, whereby excellent mechanical properties can be uniformly given to the predetermined portion of the casting. The collision of the hardening materials is not concentrated at the lower part of the casting by gravity, and hence there is no need to repeat the oscillating with changing the manner of placing of the casting.

Using the vertically oscillating working device of the present invention, it is possible to give the desired mechanical properties to a casting by forming a dense layer having a given thickness on the surface side of the casting by oscillating the casting together with the hardening material to uniformly collide the hardening material with the casting. Specifically, for example, when the casting (body to be worked) is a vehicle wheel, for example, rim portion can be made thin by giving high mechanical properties thereto. Moreover, it is possible to correct minute defects (casting defects) such as pin holes of vehicle wheels. By removing the pin holes, problems such as blisters, cracking, burrs and peeling of the coated surface which may be caused after coating can be inhibited.

In the preferred embodiment of the vertically oscillating working device of the present invention, a counter weight is fitted to one of the two cranks which is not connected with oscillating plate through connecting rod, and the counter weight acts as a balancer to remove bad vibration. Therefore, operation environment is improved, and influence on the environment around factories is diminished. Furthermore, since burden on the body to be oscillated is reduced, the effect of working treatment on the body to be worked can be surely expected. Moreover, the burden on the device per se is reduced to result in decrease in maintenance frequency of the device.

In the preferred embodiment of the vertically oscillating working device of the present invention, an air spring is provided between the oscillating mechanism and the floor on which the oscillating mechanism is placed, and furthermore, a weight is provided on the both sides of the oscillating mechanism and just above the air spring, whereby natural frequency can be reduced, and also the load can be equalized by correcting one-sided load of oscillating mechanism. Therefore, the influence of bad vibration on the body to be oscillated including the body to be worked and on the device per se can be inhibited.

DESCRIPTION OF REFERENCE NUMERAL

Figure 1:
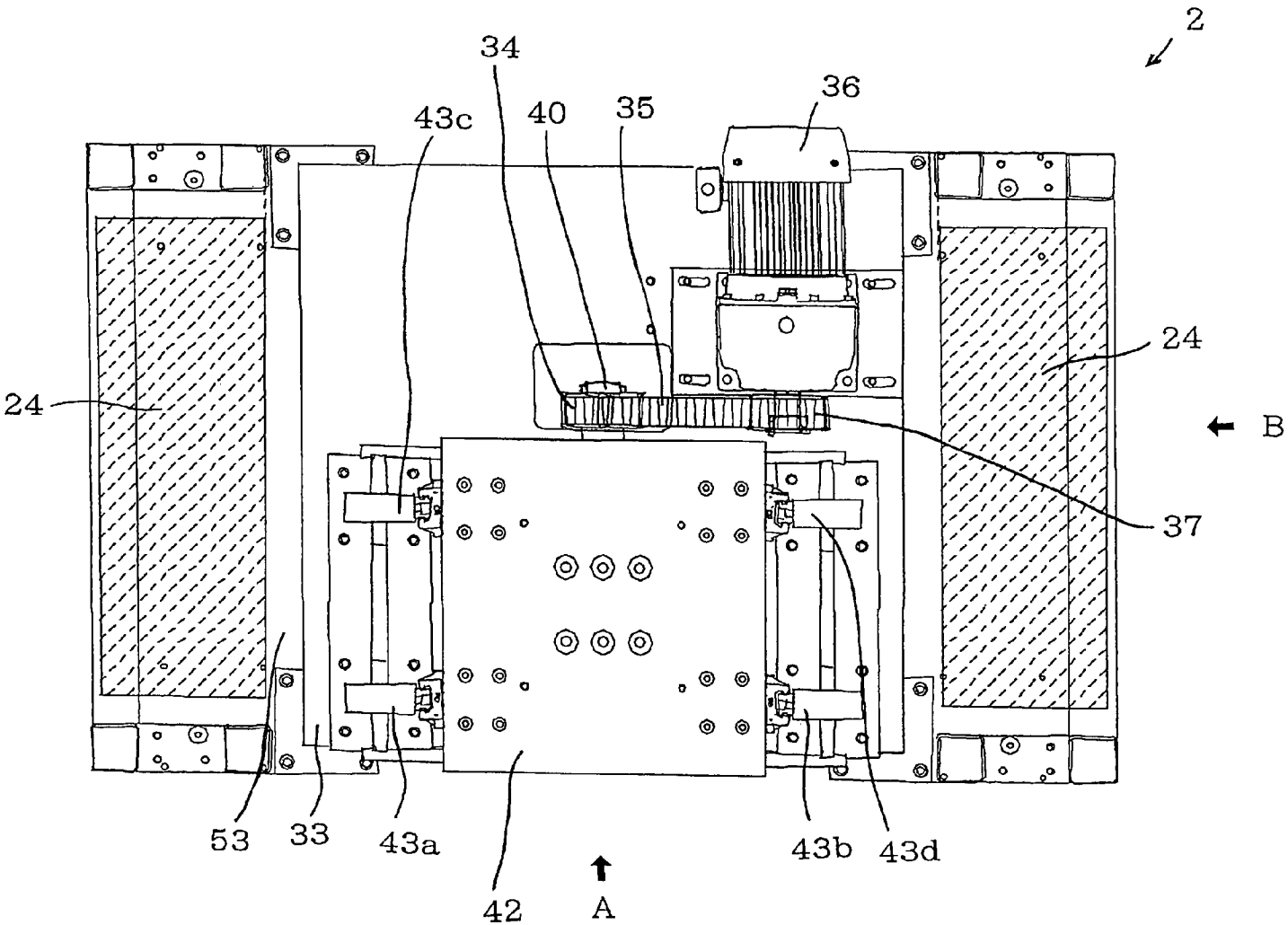
FIG. 1 shows a top view of one embodiment of the vertically oscillating working device of the present invention.

2: Vertically oscillating working device
21: Cover member
22: Vehicle wheel
23: body to be oscillated
24: Weight
31: Air spring
32: Counter weight
33: Base plate
34: Pulley
35: Belt
36: Prime mover
37: Pulley
38, 39: Crank
40: Revolving shaft
41: Connecting rod
42: oscillating plate
43*a*, 43*b*, 43*c*, 43*d*: Linear bearing
45: Bearing
46: Base stand

BEST MODE FOR CARRYING OUT THE INVENTION

Embodiments of the present invention will be explained below referring to the drawings, which should not be construed as limiting the invention in any manner. Various changes, modification, improvement and replacements can be made based on the knowledge of those skilled in the art, so long as the gist of the present invention is not damaged. For example, the drawings show suitable embodiments of the present invention, but the present invention is not restricted by the embodiments represented by the drawings or the information shown in the drawings. For practice or verification of the present invention, there may be applied means similar or equivalent to those mentioned in this specification, and suitable means are as described below.

Figure 2:
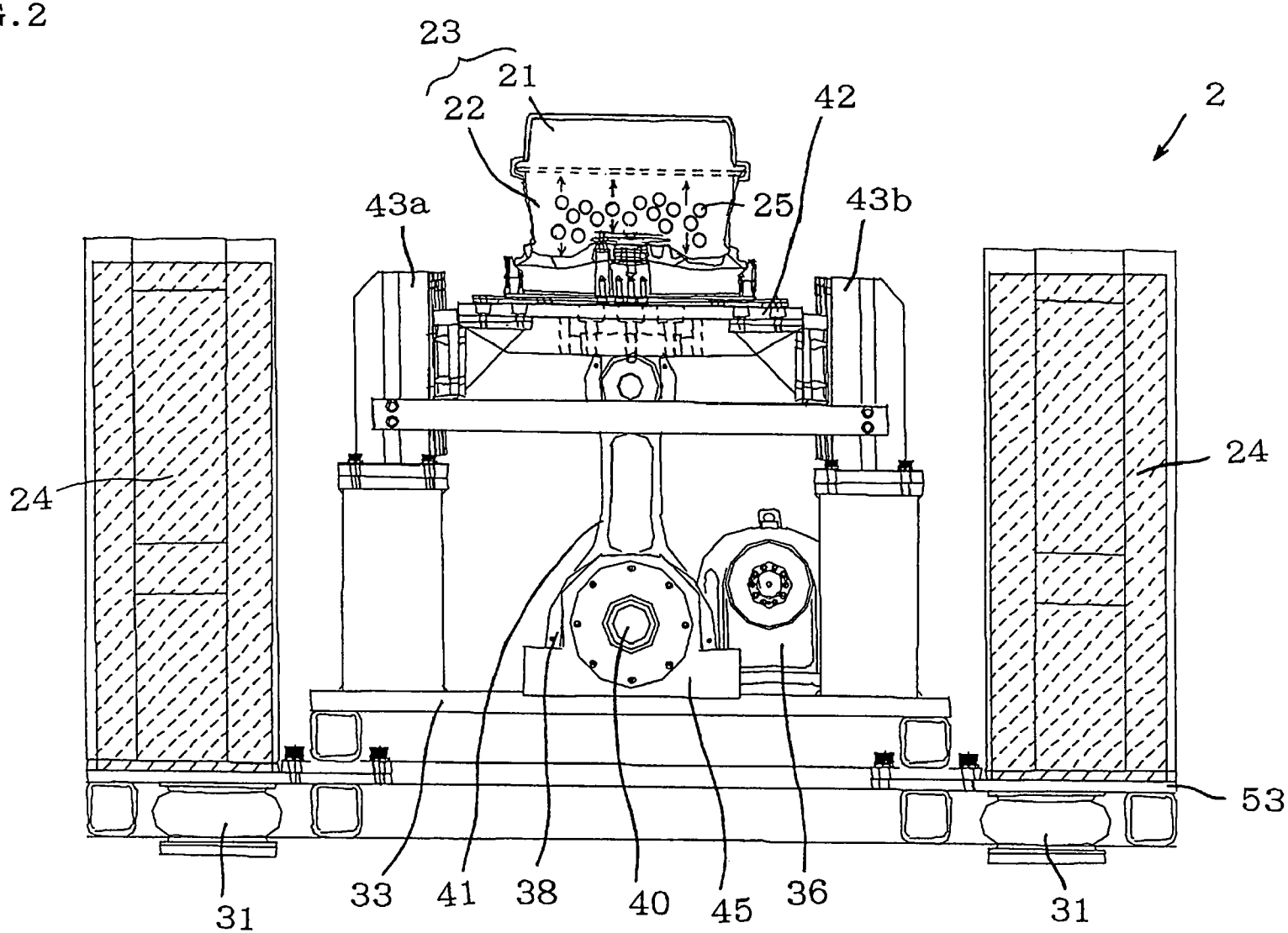
FIG. 2 shows the vertically oscillating working device of the present invention shown in FIG. 1 viewed from the direction of arrow A.
Figure 3:
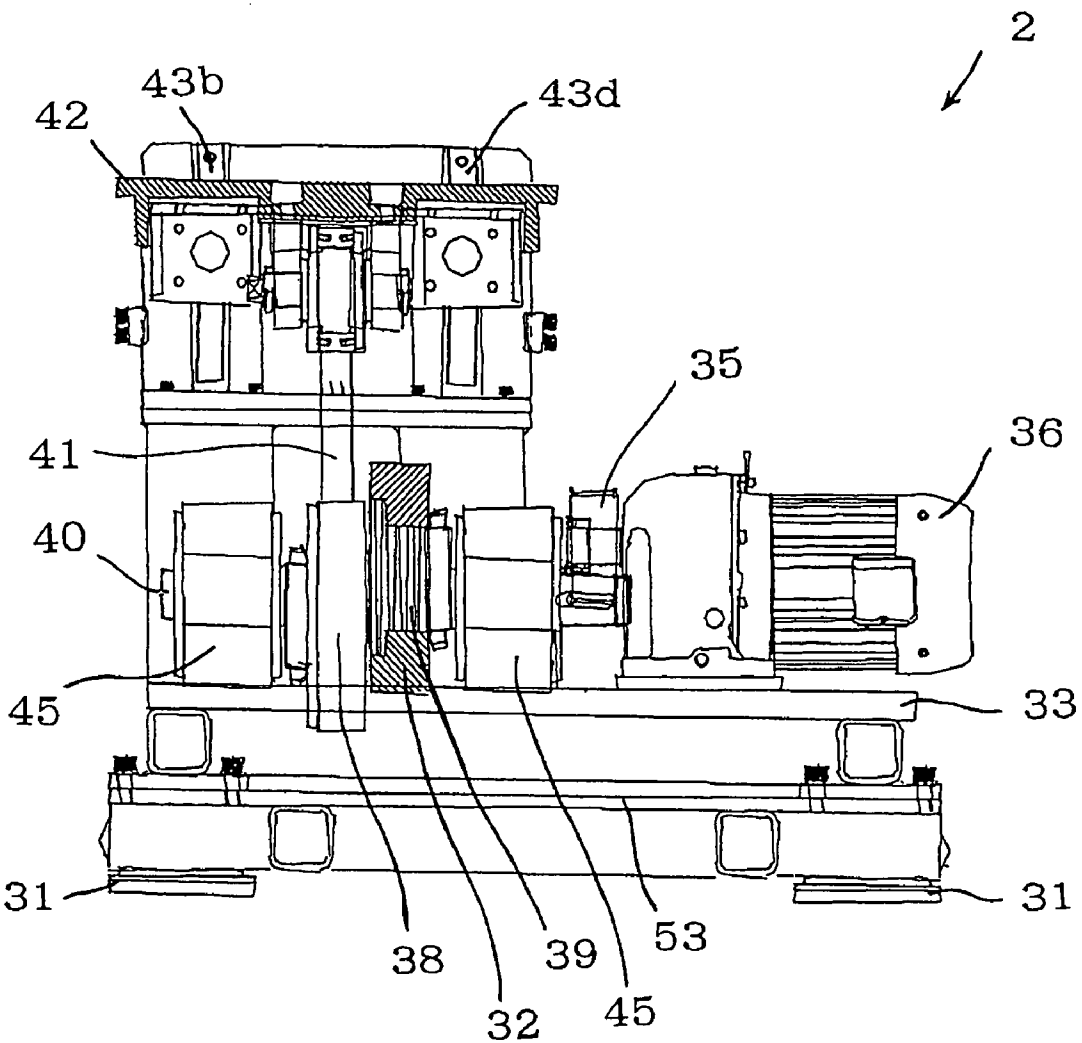
FIG. 3 shows the vertically oscillating working device of the present invention shown in FIG. 1 viewed from the direction of arrow B (viewed eliminating the weight).

FIG. 1 is a top view showing one embodiment of the vertically oscillating working device of the present invention. FIG. 2 shows the vertically oscillating working device of the present invention viewed from the direction of arrow A in FIG. 1 (front view). Only in FIG. 2, a body to be oscillated 23 is illustrated seeing-through the inside. The body to be oscillated 23 has an inner space that is formed by a cover member 21 and a vehicle wheel 22 which is a body to be worked, and receives working materials 25 in it, and the body to be oscillated 23 is fixed on a oscillating plate 42. FIG. 3 shows the vertically oscillating working device of the present invention viewed from the direction of arrow B in FIG. 1 (right side view) and views the oscillating mechanism (explained hereinafter) eliminating the weight 24.

In the vertically oscillating working device 2 shown in FIGS. 1-3, the power used for oscillating is given by the prime mover 36. The rotary motion given by the prime mover 36 is transmitted to revolving shaft 40 by belt 35 as transmitting member to revolve the revolving shaft, and the rotary motion of the revolving shaft 40 is converted to reciprocating motion by the crank 38 fitted to the revolving shaft. Then, the oscillating plate 42 connected with crank 38 through connecting rod 41 linearly reciprocates in upward and downward directions (vertical direction) along four linear bearings 43*a*, 43*b*, 43*c*, 43*d* provided as linear motion guides, and the body to be oscillated 23 fixed on the oscillating plate 42 is vertically oscillated by the reciprocation motion of the oscillating plate 42. A counter weight 32 is fitted to another crank 39 provided at revolving shaft 40, and removes and inhibits bad vibration generated by reciprocating motion of oscillating plate 42 and oscillating of body to be oscillated 23.

In the vertically oscillating working device 2, the oscillating mechanism having prime mover 36, revolving shaft 40 (cranks 38, 39), connecting rod 41, oscillating plate 42, linear bearings 43*a*, 43*b*, 43*c*, 43*d* (linear motion guides), and counter weight 32 is placed on base stand 53 through base plate 33. That is, the oscillating mechanism is collectively placed on the base plate 33, which is further placed on the base stand 53. Under base stand 53, there are provided four air springs 31 for vibration absorption, and two weights 24 are provided just above the air springs 31 on the base stand 53. In the vertically oscillating working device 2, one weight 24 is provided correspondent with two air springs 31.

Two bearings 45 are fitted to base plate 33, and revolving shaft 40 is revolvably fitted in parallel to the base plate 33 by the two bearings 45. Then, the revolving shaft 40 is connected with (revolving shaft of) prime mover 36 through belt 35. Specifically, pulley 37 provided at (revolving shaft of) prime mover 36 and pulley 34 provided at revolving shaft 40 are connected to each other by belt 35 to transmit the rotary motion generated by prime mover 36 to revolving shaft 40. The number of revolution of revolving shaft 40 can be controlled by changing the diameter of pulleys 34, 37 in combination with controlling of revolution of prime mover 36. By controlling the number of revolution, the oscillating number (vibration number) applied to the reciprocating motion (namely, oscillating of body to be oscillated) of oscillating plate 42 can be controlled.

The oscillating plate 42 on which the body to be oscillated 23 is placed and fixed is constructed as a flat plate which can be conveniently used and is superior in applicability, and movably fitted to the four linear bearings 43*a*, 43*b*, 43*c*, 43*d*. The linear bearing is one of the linear motion guides, and is a bearing which uses, for example, ball or roller for guiding the oscillating plate which carries out the reciprocating motion.

Two cranks 38, 39 are provided facing opposite at an angle of 180° at revolving shaft 40. Crank 38 is connected with oscillating plate 42 through connecting rod 41, while counter weight 32 is fitted to crank 39. According to such embodiments of cranks 38, 39, the rotary motion given by the prime mover 36 is converted to vertical reciprocating motion of oscillating plate 42 connected to crank 38, and thus the body to be oscillated 23 fixed on the oscillating plate 42 oscillates vertically while inhibiting bad vibration. Thus, since the body to be oscillated 23 has an inner space that is formed by a vehicle wheel 22, which is a body to be worked, and a cover member 21, and receives working materials 25 in it, the working materials 25 are uniformly collided with the respective portions of the vehicle wheel 22 without being affected by gravity, thereby to give the desired mechanical properties to the vehicle wheel 22. The working materials are preferably steel balls having a diameter of 3-30 mmϕ. The oscillating conditions are preferably a oscillating number (number of vibration) per 1 second of about 3-30 Hz and a oscillating amplitude (vibrational amplitude) of about 10-500 mm. The total oscillating time is preferably about 3-180 minutes. The vertically oscillating working device of the present invention can be made by working a steel plate and combining the worked plate with commercially available respective members, and in making it, preferably suitable size, material and mechanical strength of the respective constituent elements (e.g., diameter and material of the revolving shaft) are determined in accordance with oscillating conditions and specification of the body to be worked.

INDUSTRIAL APPLICABILITY

The vertically oscillating working device of the present invention can be utilized as a means to work a body to be worked by colliding working materials with the body to be worked by oscillating. For example, high mechanical properties are given by colliding steel balls against a vehicle wheel, and rim portion can be made thin for weight saving. Moreover, by colliding steel balls against a vehicle wheel, pin hole defects of the vehicle wheel can be removed.

The invention claimed is:

1. A vertically oscillating working device which has a body to be oscillated comprising:

an inner space that is formed by a cover member and a body to be worked, and receives working materials in it, an oscillating means for vertically oscillating the body to be oscillated, and which works the body to be worked by colliding the working materials with the body by oscillation, the oscillating means has an oscillating mechanism having a prime mover, a revolving shaft connected to the prime mover, a crank provided at the revolving shaft, an oscillating plate connected with the crank through a connecting rod, and two or more linear motion guides which are fitted to the oscillating plate and vertically reciprocate the oscillating plate, and the rotary motion given by the prime mover is converted to vertical motion by the crank provided at the revolving shaft, and the oscillating plate connected with the crank reciprocates vertically along the linear motion guide, thereby to vertically oscillate the body to be oscillated fixed at the oscillating plate, and an air spring being provided between the oscillating mechanism and a floor on which the oscillating mechanism is placed.

2. A vertically oscillating working device according to claim 1, wherein an other crank is further provided at the revolving shaft, and a counter weight is fitted to the other crank.

3. A vertically oscillating working device according to claim 1, wherein a weight is provided on both sides of the oscillating mechanism and just above the air spring.

4. A vertically oscillating working device according to claim 1, wherein the working materials are steel balls having a diameter of 3-30 mmϕ.

5. A vertically oscillating working device according to claim 1, wherein the body to be worked is a vehicle wheel.

* * * * *